US005673516A

United States Patent [19]

Hughes et al.

[11] Patent Number: 5,673,516

[45] Date of Patent: Oct. 7, 1997

[54] SLIDING DOOR CORNER CONNECTOR

[75] Inventors: Stephen J. Hughes, Scarborough; Bernard H. Robbins, Brampton, both of Canada

[73] Assignee: The Stanley Works, New Britain, Conn.

[21] Appl. No.: 583,281

[22] Filed: Jan. 5, 1996

[51] Int. Cl.[6] ..... E05D 15/36

[52] U.S. Cl. ..... 49/425; 49/403

[58] Field of Search ..... 49/403, 425; 16/105, 16/32

[56] References Cited

U.S. PATENT DOCUMENTS

| | | | |
|---|---|---|---|
| 3,011,209 | 12/1961 | Majeske | 16/105 |
| 3,298,136 | 1/1967 | Saunders | 49/425 |
| 3,460,290 | 8/1969 | Wutzke | 49/425 |
| 4,262,451 | 4/1981 | Dallaire | 49/425 |
| 4,391,019 | 7/1983 | Downes . | |
| 4,633,615 | 1/1987 | Moose | 49/425 |
| 4,850,145 | 7/1989 | McAfee | 49/425 |
| 4,884,371 | 12/1989 | Gagnon . | |
| 5,349,783 | 9/1994 | Jasperson et al. | 49/425 |

FOREIGN PATENT DOCUMENTS

WO9502105 1/1995 WIPO .

*Primary Examiner*—Kenneth J. Dorner
*Assistant Examiner*—Curtis Cohen
*Attorney, Agent, or Firm*—Pepe & Hazard

[57] ABSTRACT

A rigid corner connector for a door having a frame with stiles and rails seating a panel therein, includes a bracket having a generally planar body portion with perpendicular sidewalls defining a channel and having inwardly extending lips along an intermediate portion. An end wall extends between the sidewalls at one end thereof, and an end flange at the other end extending in the opposite direction and having tabs engaging the rail thereon. The sidewalls also have outwardly extending side flanges adjacent their ends, and the side flanges adjacent the end flange have a tab engageable in the end of the stile. The other side flange has a tab engageable in a slot in the wall of the stile. A roller mounting member is slidably seated in the bracket for sliding movement on the bracket and it transfers loads to the end wall. A roller is rotatably mounted on the mounting member, and a detent tab seated in a channel in the roller mounting member limits the movement of the mounting member on the bracket.

22 Claims, 5 Drawing Sheets

SLIDING DOOR CORNER CONNECTOR

BACKGROUND OF THE INVENTION

The present invention relates to corner connectors for sliding doors, and, more particularly, to such connectors including a bracket to couple the door frame members and a roller upon which the door is moved.

Corner connectors for sliding doors which include bottom rollers or other track guiding devices which permit the door to slide along a track disposed on the floor are known. Exemplary of such connectors is that described and illustrated in U.S. Pat. No. 4,391,019 issued to Downes on Jul. 5, 1983. This connector employs a vertically disposed arm which is slidably connected to a bracket by a longitudinal slot which seats a T-shaped projection on the connector bracket. The slot in the arm includes a portion of increased width to permit the head of the T-shaped projection to be inserted into the slot and thereafter be captured by the narrower portion of the remainder of the slot. In this way, the stem of the T-shaped projection moves within the slot. One problem with this arrangement is that the stem of the T-shaped projection offers a limited surface against which the arm bears during relative movement. Since the arm also carries the track guide member, e.g., a roller or the like, it is subject to loads which act on the door, particularly when the arm carries a roller which supports the bottom of the door. Hence, the bracket to arm connection experiences loads in different directions which are not readily transferred to contiguous bearing surfaces. The arm is substantially unsupported along its sides and along the interconnecting surfaces which cause the forces to be distributed unevenly and become concentrated. Such force concentration can lead to material wear and fatigue, particularly in the T-shaped arm and slot connection disclosed in U.S. Pat. No. 4,391,019.

The sliding door bracket also provides the support for the door in the track system in which it moves so that it slides freely without excessive play. Thus, it is important that the connector be rigid and securely connect the components of the sliding door to one another. This connection between the stile and the bottom rail is at a right angle and the door panel is to be held tightly therebetween. In the past, one way to assure such a rigid connection was to rivet the connector to the framing members. However, it has now been found that it is more desirable and cost effective to permit the consumer to assemble the door on site. Thus, any such connector must be easily assembled with the component parts.

Accordingly, it is an object of the present invention to provide a novel connector for sliding doors which includes a bracket which may be fabricated relatively inexpensively and which is readily connectable to the sliding door frame components by a consumer without complex tools and/or a high degree of skill.

It is also an object to provide such a connector which is relatively long-lived and supports a roller.

Another object is to provide such a connector which is provided with tabs which are readily connected to the assembled sliding door frame members to hold the door panel and its framing securely in an assembled condition.

SUMMARY OF THE INVENTION

It has now been found that the foregoing and related object may be readily attained in a rigid corner connector for a door having a frame with stiles and rails seating a panel therein which includes a bracket having a generally planar body portion with sidewalls extending generally perpendicularly to the body portion along the opposite sides thereof. These sidewalls have inwardly extending lips along an intermediate portion of the length thereof which extend parallel to the body portion to define a channel therebetween.

The product also has an end wall extending between the sidewalls perpendicularly to the body portion at one end thereof, and an end flange at the other end of the body portion extending oppositely of the sidewalls and end wall. The end flange has means for engaging a generally horizontally disposed rail thereon, and the sidewalls also have outwardly extending side flanges adjacent the ends thereof. The side flanges adjacent the end flange having a first tab engageable in the end of a stile and the other side flange has a second tab engageable in a slot in a wall of the stile. The bracket is engageable with the ends of the stile and rail by engaging the first tab in the open end of the stile and the second tab in a slot on the sidewall of the stile, and the end flange engages the rail.

A roller mounting member is slidably seated within the channel of the bracket for sliding movement of the body portion of the bracket in a direction generally parallel to said sidewalls. The roller mounting member includes means for transferring loads to the bracket end wall. A roller is rotatably mounted on the roller mounting member and extends outwardly of the bracket for movement along a track.

The roller mounting member has a slot or channel in its surface adjacent the body portion of the bracket terminating inwardly of its ends, and the body portion of the bracket has a deflectable detent extending into the channel which is deflectable to permit insertion of the mounting member into the channel and thereafter limits movement of the mounting member outwardly of the channel.

In one embodiment, the roller mounting member is of generally U-shaped cross section with an end wall and spaced sidewalls between which the roller is rotatably mounted and extends outwardly thereof.

The roller mounting member end wall includes an aperture, and the load transferring means is a threaded fastener threadably seated in the aperture in the end wall, and with the head of the threaded fastener abutting the end walls of the bracket. Desirably, the bracket end wall has an aperture therein aligned substantially with the aperture in the mounting member end wall, and it is of a diameter smaller than the head of the fastener. This aperture permits access for a tool to engage the head of the fastener to adjust the spacing between the mounting member end wall and the bracket end wall and thereby the distance which the roller projects from the bracket.

Preferably, the tab on the other flange is configured to snap fit within the slot formed in the vertical stile. The side flanges have portions extending in parallel planes, and the other side flange may be spaced further from the plane of the body portion and the tab on the first mentioned side flange.

Desirably, the tab on the first mentioned side flange is generally G-shaped with a deflectable tab at its free end to provide a snap fit in the stile. The flange adjacent the bracket end wall has a notch which seats the end wall to support it.

The tab engageable in the open end of the stile has an end portion extending at an angle away from the end flange. The side flanges have second tabs extending outwardly in a common plane to abut the outer surface of the stile. The end flange includes tabs extending parallel to the body portion to seat in slots in the rail to effect engagement therewith.

In one embodiment, the generally U-shaped roller mounting member is formed from sheet metal and the sidewalls have apertures therein seating a shaft upon which the roller is mounted. Each sidewall has an inwardly extending annular boss concentrically formed about the aperture to limit the movement of the roller perpendicularly to the sidewalls. In another embodiment, the roller mounting member is formed of synthetic resin and includes guide elements at its end disposed outwardly of the bracket.

The other side flange may have a slot formed therein adjacent its tab for receiving a tool to break off the G-shaped tab. This embodiment may also include a weakened portion.

DETAILED DESCRIPTION OF THE PREFERRED EMBODIMENT

Turning first to FIGS. 1–4 of the attached drawings, therein illustrated is a connector for sliding doors embodying the present invention and generally designated by the numeral 1. The sliding door is comprised of a panel 2 such as a mirror or laminated hardboard and a frame provided by the stiles 6 at its side edges and the rails 8 along its top and bottom edges.

Figure 1:
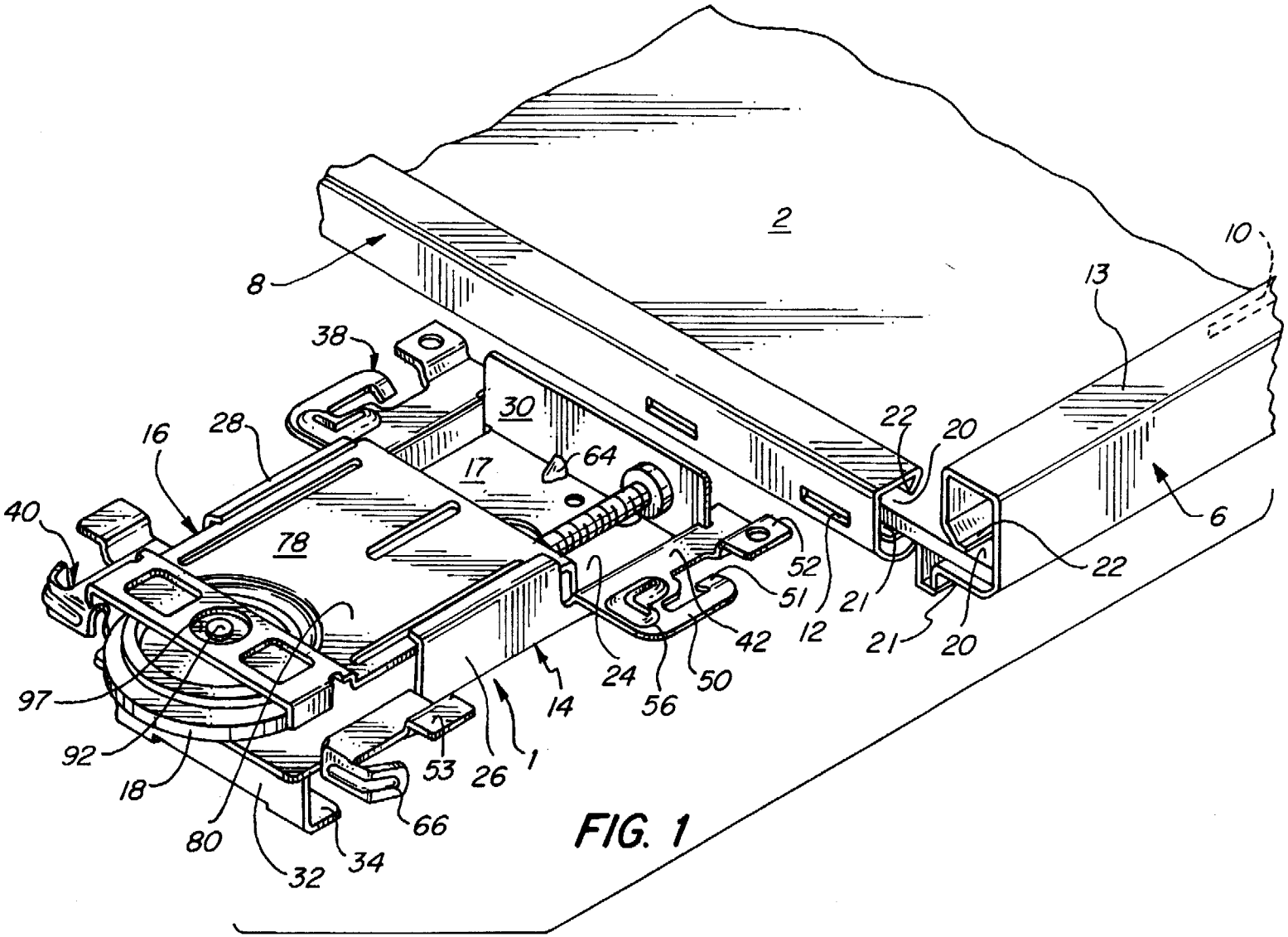
FIG. 1 is a fragmentary perspective view of a door panel with its frame members and of a connector embodying the present invention prior to its assembly therewith.
Figure 3:
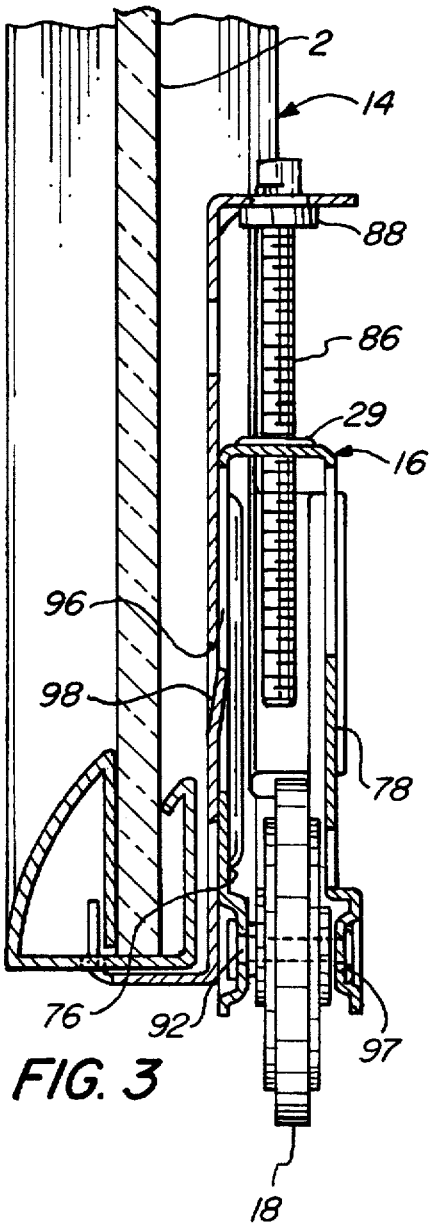
FIG. 3 is a sectional view along the line 3—3 in FIG. 2.

As illustrated in FIGS. 1 and 3, the cross sectional configuration of the stiles 6 and the rails 8 provides channels 20 which receive the edges of the panel 2. The channel 20 is defined by an elongated depending wall 21 and a short, deflectable depending lip 22 to seat the panel 2 snugly therebetween. Each rail 8 has a pair of longitudinally spaced and extending slots 12 adjacent each end thereof. Adjacent the end of each stile 6 is provided a longitudinally extending slot 10 so that when the ends of the stiles 6 and rails 8 are brought together at right angles the slots 10, 12 will receive portions of the connector 1 to effect a connection therebetween.

Figures 5, 6, 7:
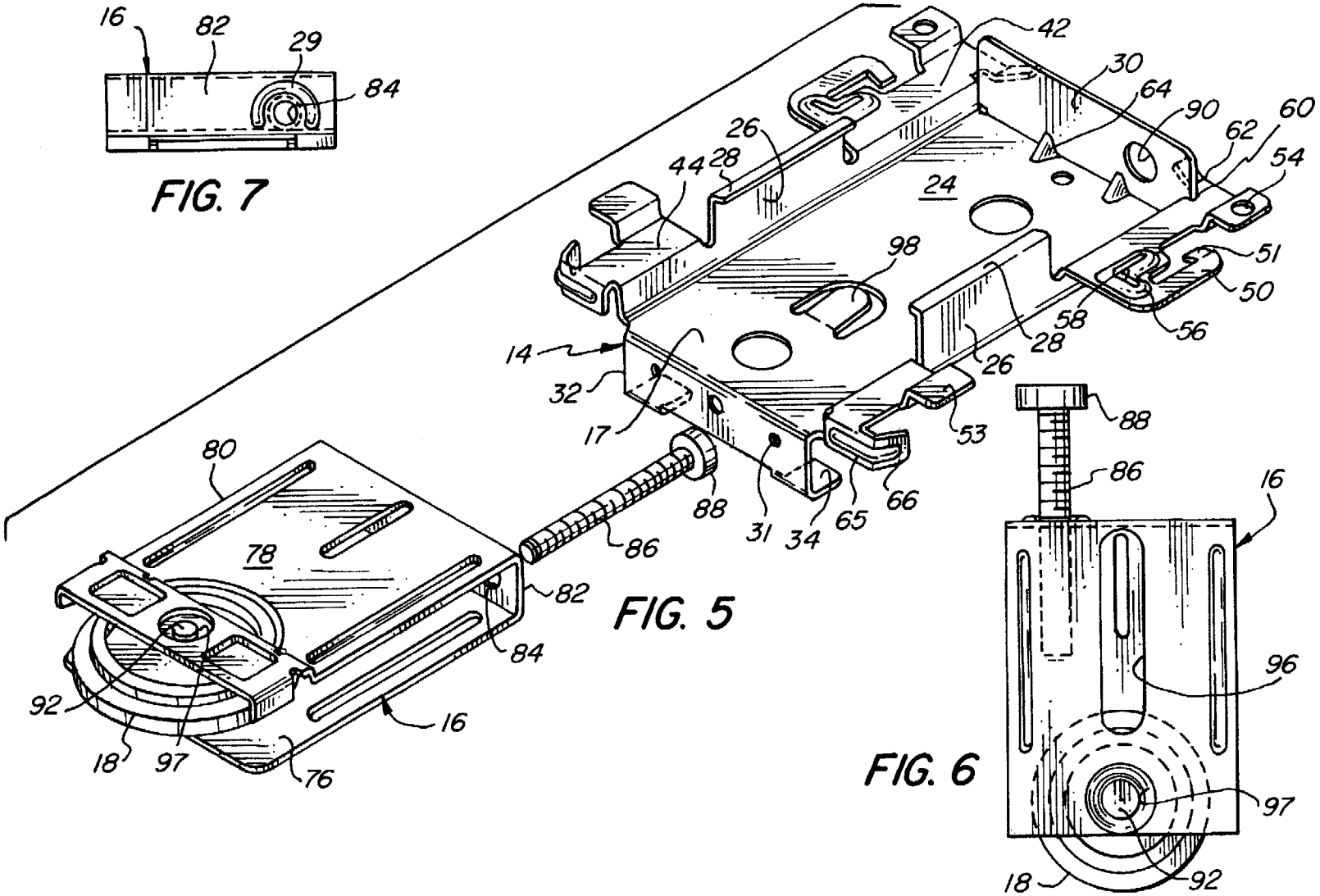
FIG. 5 is a partially exploded perspective view of he connector.
FIG. 6 is a side elevational view of the roller mounting member shown apart from the mounting bracket.
FIG. 7 is a top view of the roller mounting member.

As seen in FIGS. 1 and 5, the connector 1 is elongated and is comprised of a bracket generally designated by the numeral 14 and roller mounting member generally designated by the numeral 16 which is slidably seated within the bracket 14 and which has a track engaging roller 18 at its lower end to support the weight of the door as it moves along a floor track (not shown). The bracket 14 has a generally planar body portion 24 having an inner surface 17 upon which the mounting member 16 is slidable. Along the sides thereof are side walls 26 each having outwardly extending flanges 38 and 40 at the ends thereof and an inwardly extending lip 28 centrally thereof. The side walls 26 and the body portion 24 define a channel in which the roller mounting member 16 is seated, and the lip 28 retains the roller mounting member 16 therein.

As seen in FIG. 5, an end wall 30 extends perpendicularly to the upper end of the body portion 24 transversely across the width thereof between the side walls 26 to close the channel at its upper end. A flange 32 extends perpendicularly to the other or lower end of the bracket body portion 24 at its other end and in a direction opposite to the sidewalls 26 and end walls 30. Along the free end of the flange 32 is a pair of holding tabs 34 which extend parallel to the plane of the body portion 24 and seat in the slots 12 in the bottom wall of the rail 8. While illustrated as part of the bracket 14, it should be understood that the holding tabs 34 on the flange 32 may be omitted, or removed or flattened, and the flange 32 may be connected to the rail 8 by screws passing through openings 31 in the flange 32 when the rail 8 is not adapted to receive the tabs 34, such as when the frame is formed from a hardwood greater than the thickness for which its channel was intended.

Figure 2:
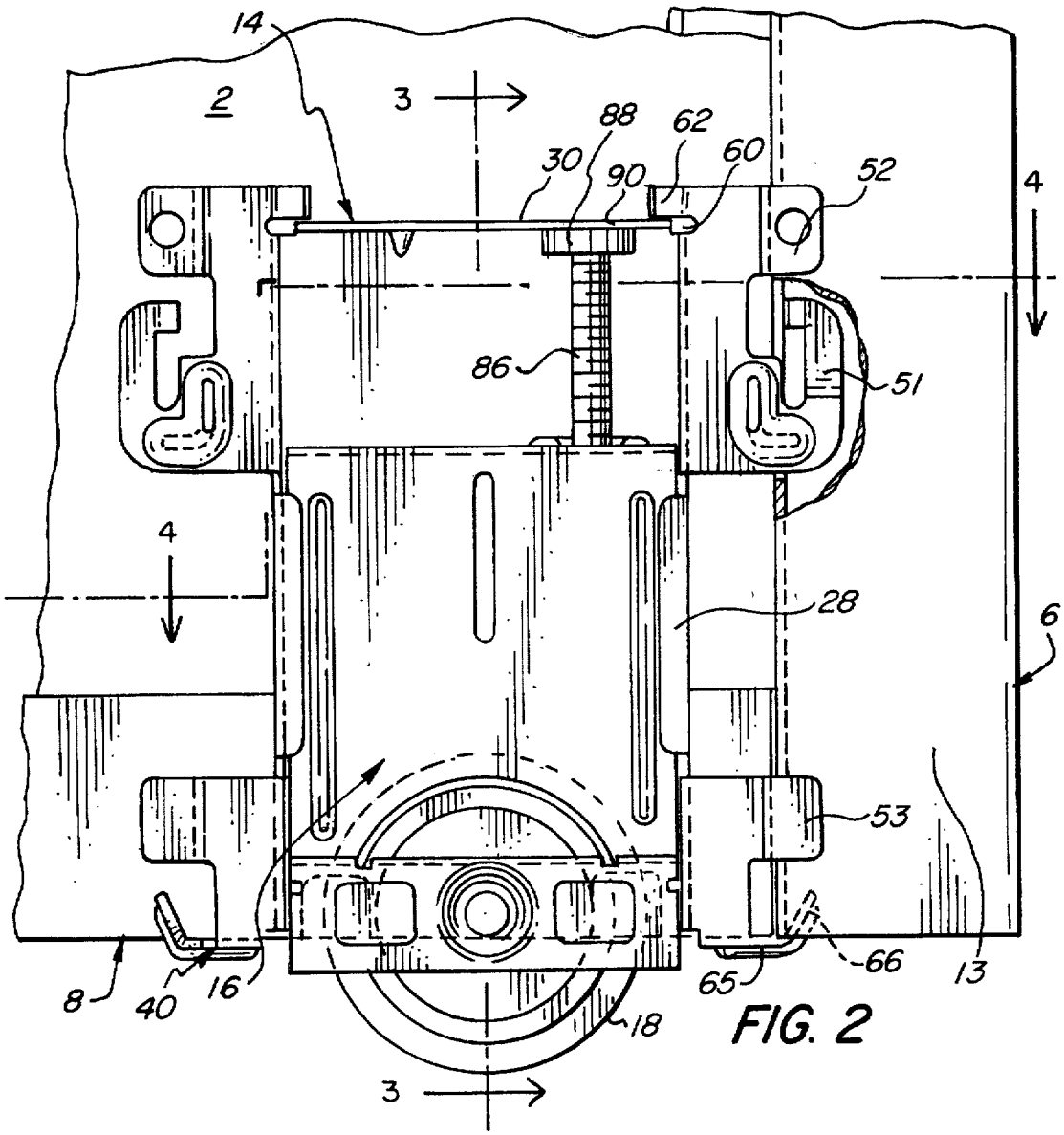
FIG. 2 is a fragmentary side elevational view of the assembled bottom right corner of the door.
Figure 4:
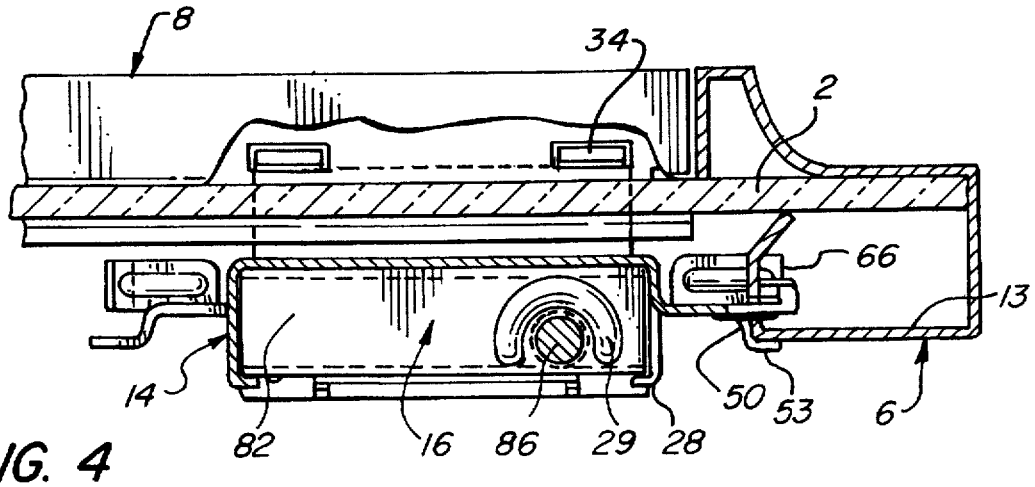
FIG. 4 a sectional view along the line 4—4 in FIG. 2.

As seen in FIGS. 1–4, the upper side flanges 38 on the bracket 14 and the lower side flanges 40 have generally planar body portions 42 and 44 extending generally parallel to the plane of the body portion 24. As seen in FIG. 1, the planar body portion 42 of the flange 38 is formed with a generally G-shaped tab 50 which has a free end providing an inturned snap tip 51. The tabs 50 are generally coplanar with the planar portion 42 except for the snap tip 51 which is angled towards the plane of the body portion 24. This allows the tip 51 to pass into the slot 10 formed in the side of the stile 6 and thereafter snap in place behind the interior surface of its side wall 13 as best illustrated in FIG. 2. An upwardly offset tab 52 on the flange 38 extends in a plane generally parallel to the plane of the bracket body portion 24 and is spaced above the plane of the planar portion 42. This cooperates with the G-shaped tab 50 and bears against the outer surface of the stile 6 to capture it therebetween.

Each G-shaped tab 50 is provided with weakening section 56 which permits the tab 50 to be broken off in the event that the stile 6 is cut adjacent its end so that the slot 10 is no longer present or aligned therewith. In this circumstance, the offset tab 52 is connected to the stile 6 by a screw (not shown) which extends through an aperture 54 in the tab 52. The weakening section 56 has an L-shaped slot 58 and a deformed region surrounding the slot 58 which allows the tab 50 to be broken off when a tool, such as a screwdriver tip, is inserted therein and moved back to flex the tab 50 until it breaks off.

Each flange 42 also includes a notch 60 which receives the upper end wall 30 therewithin. Thus, the flange 42 has a portion 62 which extends behind the end wall 30 so as to abut the outer face of the end wall 30 and provide it with enhanced load bearing capacity. This is important because the weight of the door bears on the end wall 30 by forces imparted to it through the mounting member 16. The juncture of the body portion 24 and end wall 30 may be further stiffened by providing spot welds or staking gussets 64 therealong.

As seen in FIG. 2, the lower end flange 40 secures the lower end of the bracket 14 to the open end of the stile 6. The lower end flange 40 includes at its lower end an arm portion 65 which extends outwardly of and perpendicularly to the planar body portion 40 and provides a tab 66 which extends upwardly so as to engage the inner surface of the stile 6 as best seen in FIG. 2. At its upper end, the flange 40 has an upwardly offset, outwardly extending tab 53 which extends parallel to the body portion 24 along the outer surface of the stile 6. The tab 66 works in conjunction with the offset tab 53 to seat the wall of the stile 6 therebetween.

Figure 8:
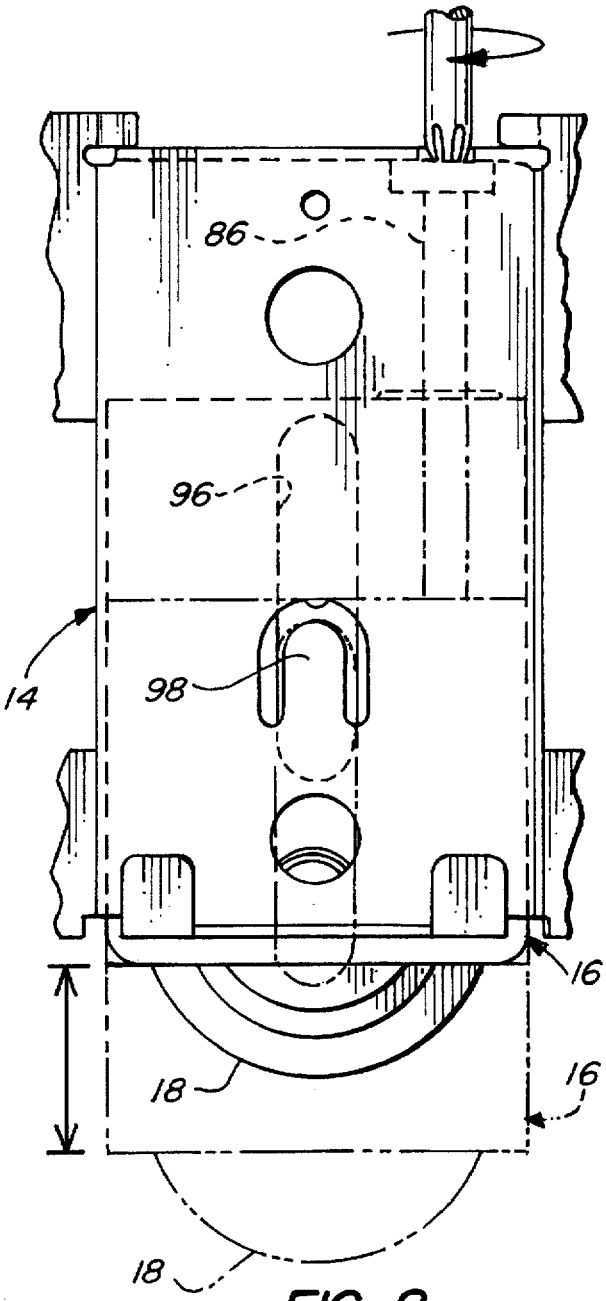
FIG. 8 is a partially fragmentary elevational view of the connector and panel assembly showing in phantom line an adjusted portion of the roller mounting member and also showing a screwdriver blade to effect the adjustment.

As seen in FIG. 5, the roller mounting member 16 is cooperatively dimensioned to slidingly seat in the channel of the bracket 14 and has a generally rectangular configuration with its upper end portion seated within the channel of the bracket 14 and its lower end portion extending below the bracket 14. In this embodiment, the roller mounting member 16 has a generally U-shaped body 80 with spaced sidewalls 76 and 78 which extend generally parallel to the plane of the body portion 24 of the bracket 14 and an end wall 82 at its upper end. As seen in FIGS. 7 and 8, the end wall 82 of the roller mounting member 16 is provided with an aperture 84 which threadably seats a machine screw 86 having a head 88 which abuts against the lower surface of the end wall 30 of the bracket 14 to transfer the door load to it. The end wall 82 is provided with a stiffening rib 29 about the aperture 84. The screw 86 enables adjustment of the position of the roller mounting member 16 and thereby the door height above the supporting surface and reduces play in the door by allowing the door to be moved upwardly snugly against the upper track (not shown). The end wall 30 has an access aperture 90 therein which permits a screwdriver blade to be inserted through the end wall 30 of the bracket 14 to engage the head 88 of the screw 86 in order to make such adjustments.

The roller 18 is rotatably mounted adjacent the lower end of the mounting member 16 on a shaft 92 which extends through aligned apertures in the sidewalls 76 and 78. As seen in FIG. 3, about each of the apertures 93 in the sidewalls 76 and 78 of the mounting member 16 is an annular inwardly deformed portion 97 which centers the hub of the roller 18 within the mounting member 16 and spaces the circumferential portion of the roller 18 from the sidewalls 76, 78.

The roller mounting member 16 as shown in FIGS. 3 and 8 is limited in its movement outwardly of the bracket 14 by a detent or tab 98 which extends inwardly from the body portion 24 and seats in the elongated slot 96 in the sidewall 76 of the mounting roller member 16. The detent 98 is resiliently deflectable to be deflected into the plane of the bracket body portion 24 when the upper end of the roller mounting member 16 is inserted into the bracket 14 until it springs into the slot 96 upon continued movement of the mounting member 16 toward the upper end flange 30 of the bracket 14.

Figure 9:
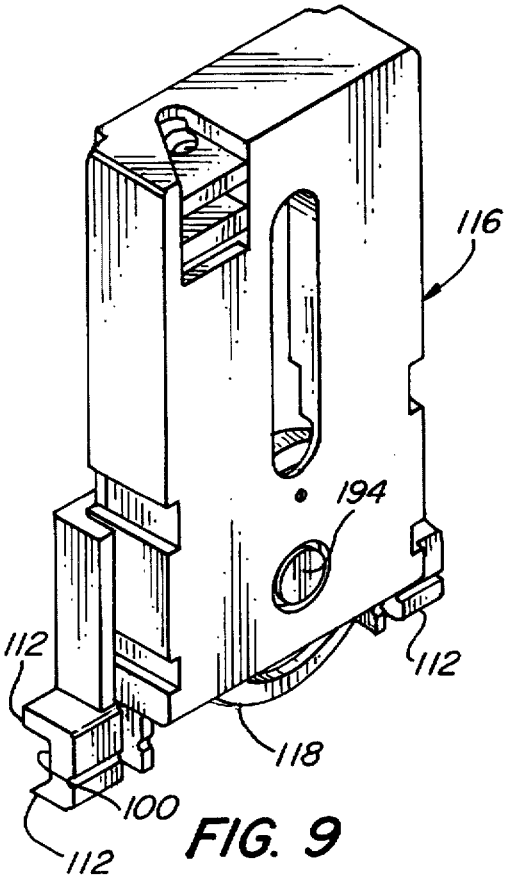
FIG. 9 is a perspective view of another embodiment of the roller mounting member.
Figure 10:
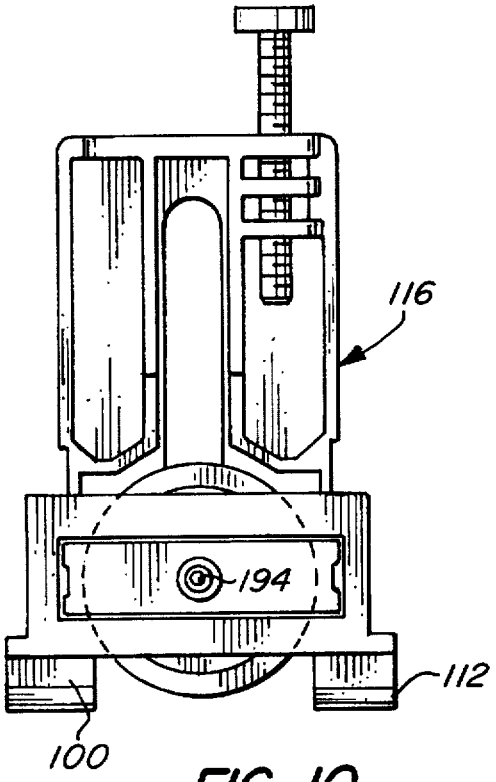
FIG. 10 is a side elevational view of the mounting member of FIG. 9.

In FIGS. 9 and 10, there is illustrated another embodiment of roller mounting member 116. This member 116 is a molded synthetic resin block which similarly rotatably mounts a roller 118 about a transversely extending shaft 194 journaled in the sidewalls of the block. The block may be formed from various materials, including glass impregnated nylon, acetal or other durable resins. At the lower end of the member 116 is a deflectable depending track follower element 100 having horizontal portions 112 which engage the track (not shown) to prevent derailing of the roller 118.

Figure 12:
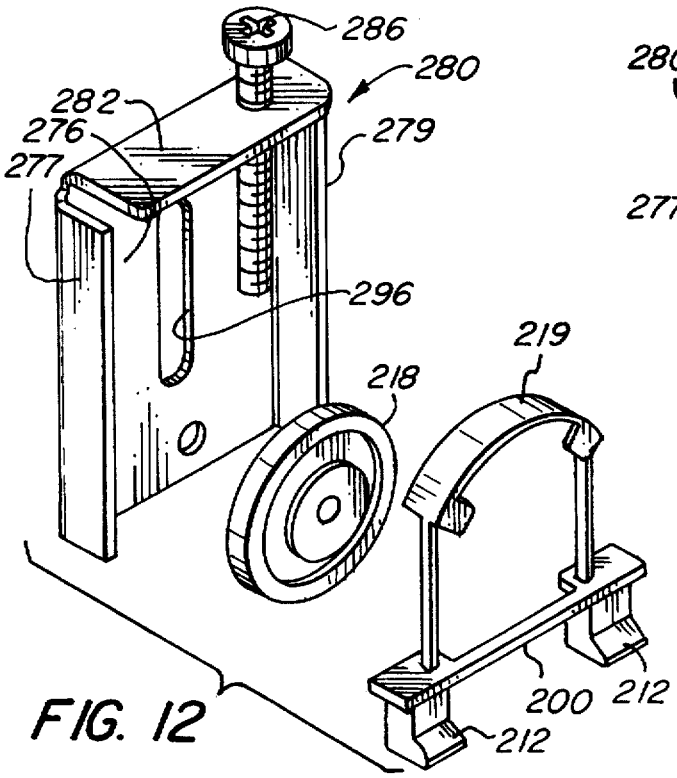
FIG. 12 is a partially exploded view of the roller mounting member of FIG. 11.
Figure 11:
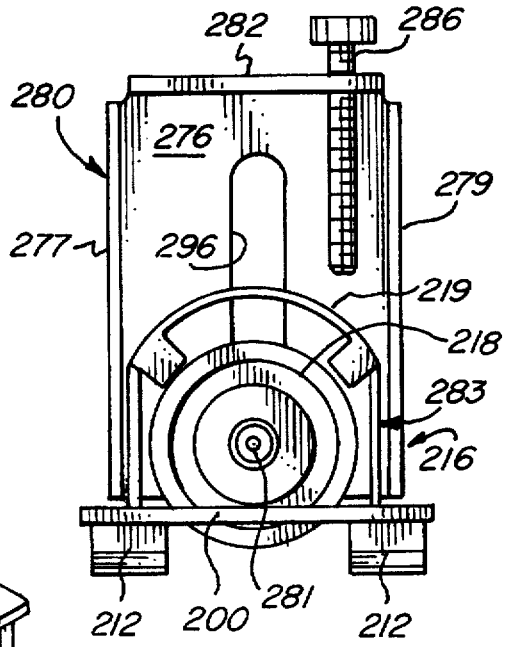
FIG. 11 is a front elevational view of still another embodiment of roller mounting member.

In FIGS. 11 and 12 there is illustrated a further embodiment of roller mounting member generally designated by the numeral 216 which utilizes a body 280 formed of sheet metal with a base wall 276, side walls 277, 279 and an end wall 282 at its upper end which seats the screw 286. The base wall 280 has an elongated slot 296 which cooperates with the detent 98 in the bracket 14. The roller 218 is rotatably mounted on the base wall 276 by a rivet 281, and an antijump member 283 is disposed thereabout. The antijump member 283 is integrally molded and seats in the body 280. Extending above the roller 218 is an arch portion 219, and the bottom portion 200 slides on the door track (not shown) with the portions 212 engaging in the track to prevent jumping.

In assembling the connector to the panel 2 and frame elements 6, 8, the roller mounting member 16 with the roller 18 mounted therein may be initially inserted into the channel of the bracket 14 until the detent 98 snaps into the slot 96 of the mounting member 16. Thereafter, depending on whether the connector is to be used in a right or left corner of the panel, the side flanges 38 and 40 disposed along the corresponding right or left lateral side of the bracket 14 are used in the connection. In the illustrated example of FIG. 1, the right corner of the door is being connected and those along the right side of the bracket 14 are used. The tab 66 is first engaged in the open end of the stile 6 and the tabs 34 of the lower end flange 32 are inserted into the slots 12. Thereafter, the bracket 14 is pivoted toward the slot 10 in the stile 6 until the G-shaped tab 50 is inserted through the slot 10 and the tip 51 snaps against the inner surface of the stile 6. Concurrently, the tabs 52, 53 seat against the outer surface of the stile 6 and the body portion 24 seats against the outer surface of the rail 8 to engage the stile 6 and rail 8 firmly with the bracket 14. The stiles and rails are conventionally fabricated from steel or aluminum to provide a rigid frame while providing some degree of flexure to grip the panel securely. The bracket is conveniently stamped from sheet metal of about 0.030–0.050 inch thickness. The roller mounting member may be similarly stamped from sheet metal as in the embodiment of FIGS. 1–8 or molded from synthetic resin as in the embodiment of FIGS. 9 and 10. The rollers are conveniently molded from synthetic resin such as nylon, polypropylene and acetal.

Thus, it can be seen from the foregoing detailed description and attached drawings that the corner connector of the present invention is one which may be fabricated relatively inexpensively and easily connected to the door framing elements to provide a secure assembly. The roller mounting member may be preassembled in the connector or inserted after the door framing elements have been assembled.

Alternatively, the bracket 14 may be assembled to the stile 6 and rail 8 without the roller mounting member 16. After the bracket 14 has been mounted, the roller mounting member 16 may be inserted thereinto.

Having thus described the invention, what is claimed is:

1. A rigid corner connector for a door having a frame with stiles and rails seating a panel therein, comprising:

(a) a bracket having (i) a generally planar body portion with sidewalls extending generally perpendicularly to said body portion along opposite sides thereof, said sidewalls having inwardly extending lips along an intermediate portion of the length thereof, said lips extending parallel to and over said body portion to define a channel therebetween;

(ii) an end wall extending perpendicularly to said body portion at one end thereof between said sidewalls;

(iii) an end flange at the other end of said body portion extending perpendicularly to said body portion in a direction oppositely of said sidewalls and end wall, said end flange having means thereon for engagement with a generally horizontally extending rail disposed thereon, said sidewalls also having outwardly extending side flanges adjacent both ends of said body portion, the side flange adjacent said end flange having a first tab engageable in the end of a stile and the other of said side flanges having a second tab engageable in a slot in a wall of the stile, said bracket being engageable with the ends of the stile and rail by engaging said first tab in the end of the stile and said second tab engaging in the slot in the wall of the stile and said end flange engaging the rail;

(b) a roller mounting member slidably seated within said channel of said bracket and having a first surface slidably movable on said body portion of bracket in a direction generally parallel to said sidewalls, said roller mounting member including means thereon for transferring loads to said bracket end wall; and (c) a roller rotatably mounted on said roller mounting member for rotation about an axis perpendicular to the plane of said body portion and extending outwardly of said bracket for movement along a track, said roller mounting member having a channel in said first surface adjacent said body portion of said bracket and terminating inwardly of its ends, said body portion of said bracket having a deflectable detent extending into said channel which is deflectable to permit insertion of the roller mounting member into said channel and thereafter limits movement of said mounting member outwardly of said channel.

2. A connector in accordance with claim 1 wherein said roller mounting member is of generally U-shaped cross section with an end wall and spaced sidewalls between which said roller is rotatably mounted and extends outwardly thereof.

3. A connector in accordance with claim 2 wherein said roller mounting member end wall includes an aperture and wherein said load transferring means is a threaded fastener threadably seated in said aperture in said end wall, said threaded fastener having a head abutting said end wall of said bracket.

4. A connector in accordance with claim 3 wherein said bracket end wall has an aperture therein aligned substantially with said aperture in the mounting member end wall and of a diameter smaller than said head of said fastener, said aperture providing access for a tool to engage said head of said fastener to adjust the spacing between said mounting member end wall and said bracket end wall and thereby the distance which said roller projects from said bracket.

5. A connector in accordance with claim 1 wherein said tab on said other flange is configured to snap fit within the slot formed in the vertical stile.

6. A connector in accordance with claim 1 wherein said side flanges have portions extending in parallel planes, said other side flange portion being spaced further from the plane of said body portion than said tab on said first mentioned flange.

7. A connector in accordance with claim 1 wherein said tab on said other side flange is generally G-shaped with a deflectable tab at its free end to provide a snap fit in the stile.

8. A connector in accordance with claim 1 wherein said other side flange adjacent said end wall has a notch which seats said end wall to support it.

9. A connector in accordance with claim 1 wherein said tab engageable in the end of the stile has an end portion extending at an angle away from said end flange.

10. A connector in accordance with claim 1 wherein both of said side flanges have second tabs extending outwardly in a common plane to abut the outer surface of the stile.

11. A connector in accordance with claim 9 wherein said end flange includes tabs extending parallel to said body portion to seat in slots in the rail to effect engagement therewith.

12. A connector in accordance with claim 2 wherein said generally U-shaped roller mounting member is formed from sheet metal and said sidewalls have apertures therein seating a shaft upon which said roller is mounted, each of said sidewall also having an inwardly extending annular boss concentrically formed about said aperture limiting the movement of said roller in a direction perpendicularly to said sidewalls.

13. A connector in accordance with claim 1 wherein said roller mounting member is formed of synthetic resin and includes guide elements on its end disposed outwardly of said bracket.

14. A connector in accordance with claim 7 wherein said other side flange has a slot formed therein adjacent said tab thereof for receiving a tool to break off said G-shaped tab.

15. A connector in accordance with claim 14 wherein said other side flange includes a weakened portion about said tab.

16. A sliding door comprising:

(a) a pair of stiles having channels in the inner face thereof;

(b) horizontally disposed top and bottom rails having channels in the inner face thereof;

(c) a door panel seated in said channels of said stiles and rails;

(d) connectors engaged with the ends of said stiles and rails to provide a rigid framework for the door, said connectors at the bottom of the door comprising:

(e) a bracket having (i) a generally planar body portion with sidewalls extending generally perpendicularly to said body portion along opposite sides thereof, said sidewalls having inwardly extending lips along an intermediate portion of the length thereof, said lips extending parallel to and over said body portion to define a channel therebetween;

(ii) an end wall extending perpendicularly to said body portion at one end thereof between said sidewalls;

(iii) an end flange at the other end of said body portion extending perpendicularly to said body portion in a direction oppositely of said sidewalls and end wall, said end flange engaging said generally horizontally rail disposed thereon, said sidewalls also having outwardly extending side flanges adjacent both ends of said body portion, the side flange adjacent said end flange having a first tab engaged in the end of said stile and the other of said side flanges having a second tab engaged in a slot in the wall of said stile;

(f) a roller mounting member slidably seated within said channel of said bracket and having a first surface slidably movable on said body portion of said bracket in a direction generally parallel to said sidewalls, said roller mounting member including means thereon for transferring loads to said bracket end wall; and (g) a roller rotatably mounted on said roller mounting member for rotation about an axis perpendicular to the plane of said body potion and extending outwardly of said bracket for movement along a track in which said door is disposed, said roller mounting member having a channel in said first surface adjacent said body portion of said bracket and terminating inwardly of its ends, said body portion of said bracket having a deflectable detent extending into said channel which is deflectable to permit insertion of the roller mounting member into said channel and thereafter limits movement of said mounting member outwardly of said channel.

17. The sliding door in accordance with claim 16 wherein said bracket is engageable with the ends of the stile and rail by engaging said first tab in the end of the stile and said second tab engaging in the slot in the wall of the stile an said end flange engaging the rail, and wherein said roller mounting member end wall includes an aperture and wherein said load transferring means is a threaded fastener threadably seated in said aperture in said end wall, said threaded fastener having a head abutting said end wall of said bracket.

18. The sliding door in accordance with claim 17 wherein a bracket end wall has an aperture therein aligned substantially with said aperture in the mounting member end wall and of a diameter smaller than said head of said fastener and permits access for a tool to engage said head of said fastener to adjust the spacing between said mounting member end wall and said bracket end wall and thereby the distance which said roller projects from said bracket.

19. The sliding door in accordance with claim 17 wherein said tab on said other flange is configured to snap fit within the slot formed in the vertical stile.

20. The sliding door in accordance with claim 17 wherein said tab on said other side flange is generally G-shaped with a deflectable tab at its free end to provide a snap fit in the stile.

21. The sliding door in accordance with claim 17 wherein said tab engageable in the end of the stile has an end portion extending at an angle away from said end flange, and wherein both of said side flanges have second tabs extending outwardly in a common plane to abut the outer surface of the stile.

22. The sliding door in accordance with claim 17 wherein said end flange includes tabs extending parallel to said body portion to seat in slots in the rail to effect engagement therewith.

* * * * *